US008467126B2

(12) United States Patent
Faubion

(10) Patent No.: US 8,467,126 B2
(45) Date of Patent: Jun. 18, 2013

(54) STAGE DRIVER FOR MOVABLE STAGES

(75) Inventor: Donald R. Faubion, Oakdale, CA (US)

(73) Assignee: Valley Precision, Inc., Oakdale, CA (US)

( * ) Notice: Subject to any disclaimer, the term of this patent is extended or adjusted under 35 U.S.C. 154(b) by 443 days.

(21) Appl. No.: 12/789,035

(22) Filed: May 27, 2010

(65) Prior Publication Data

US 2011/0290062 A1 Dec. 1, 2011

(51) Int. Cl.
*G02B 21/26* (2006.01)

(52) U.S. Cl.
USPC ..... 359/393; 74/490.13

(58) Field of Classification Search
USPC ..... 74/490.012, 490.13; 359/391, 329, 359/393
See application file for complete search history.

(56) References Cited

U.S. PATENT DOCUMENTS 4,328,713 A 5/1982 Lund
4,445,758 A 5/1984 Emmel
4,700,585 A 10/1987 Marzhauser
4,919,001 A 4/1990 Ogiwara et al.
5,140,242 A 8/1992 Doran et al.
2005/0018283 A1* 1/2005 Kimura ..... 359/393
2008/0202272 A1 8/2008 Kanayama
2010/0270476 A1* 10/2010 Nishimaki et al. ..... 250/442.11
2011/0290161 A1* 12/2011 Faubion ..... 108/137

* cited by examiner

*Primary Examiner* — David M Fenstermacher
*Assistant Examiner* — Terence Boes
(74) *Attorney, Agent, or Firm* — Schneck & Schneck; Thomas Schneck

(57) ABSTRACT

A manually operated driver for precision support stages having coarse and optional fine position control. A yoke connected to a movable stage slides along a shaft parallel to the direction of motion of the stage. The yoke has opposing pivot members that can, in one position, contact the shaft to self-lock the position of the yoke on the shaft and, in another position, remain clear of the shaft thereby allowing the yoke to slide freely on the shaft for coarse position control. The shaft has threads at one end that turn into a support block. Turning of the shaft with a knob and with the yoke locked to the shaft, slowly changes the position of the yoke and the connected stage for fine position adjustment of the stage. A pair of such drivers in orthogonal orientation on parallel x-y movable stages will provide two dimensional motion of stages.

12 Claims, 7 Drawing Sheets

STAGE DRIVER FOR MOVABLE STAGES

TECHNICAL FIELD

The invention relates to mechanisms for linear movement of stages or slides used to support precision instruments, such as microscopes, lasers, wafer devices, optical components, tools, and the like.

BACKGROUND ART

Precision stages often have a linearly moveable stage supported on a fixed stage. Sometimes two linearly movable stages are supported on a fixed stage, with one movable stage moving in the x-direction and the other moving in the y-direction. Sometimes a single movable stage is mounted in fixed support for z-direction motion. The movable stages often have provisions for coarse and fine positioning using different control devices.

U.S. Pat. No. 4,700,585 to H. Marzhauser shows a drive system for slides and x-y stages in microscopes and similar instruments having the possibilities of both fine control and rapid displacement of the slides over larger distances. The drive system comprises a friction wheel and a friction track provided between the slide and the stationary slide guide. A friction wheel together with an actuation knob are solidly fixed on a common shaft and this common shaft is displaceable against a spring force so that the friction wheel is out of contact with the friction track. A brake shoe is provided for each shaft and a clamping element is provided for each brake shoe. The shafts are supported in ball bearings. The brake shoes are closed plastic rings and the clamping elements press uniformly by their U-legs and from diametrically opposite sides against the plastic rings in the braking position, the direction of the force passing through the center axis of the coaxial shafts. Accordingly, the braking forces are applied uniformly from two sides and balance each other, whereby no force component arises which would laterally shift the coaxial shafts.

Some stage drivers use rack and pinion devices to regulate motion, while others use gears or actuators. An object of the invention is a simple, reliable and highly controllable stage driver.

SUMMARY OF INVENTION

The above object has been met with a stage driver that features a yoke affixed to a movable stage with the yoke sliding on a shaft that is supported by fixed blocks. The shaft is aligned parallel to the direction of motion of the movable stage. Sliding of the yoke on the shaft is controlled by spring biased pivot members affixed to the yoke that in one position allow sliding of the yoke along the shaft and in another position lock the yoke against the shaft. The pivot members are symmetrically arranged on opposite sides of the yoke with first inward ends that can contact the shaft in one position, namely a self-locking position, and pivot away from the shaft in another position, namely a free sliding position. When contacting the shaft, the pivot members lock the yoke in place, thereby locking the position of the movable stage relative to the shaft. When the pivot members move away from the shaft, the movable stage is free to be moved by sliding the yoke along the shaft. As an option, the shaft has screw threads at one end so that when the yoke is locked in place on the shaft, the yoke and shaft can be advanced slowly and in small amounts by turning the screw threads in a receiving support block. Such stages are suitable for supporting microscopes, optical instruments, wafer inspection equipment or tools, scientific apparatus, manufacturing equipment or wherever rapid precision motion is required.

DESCRIPTION OF BEST MODE

Figure 1:
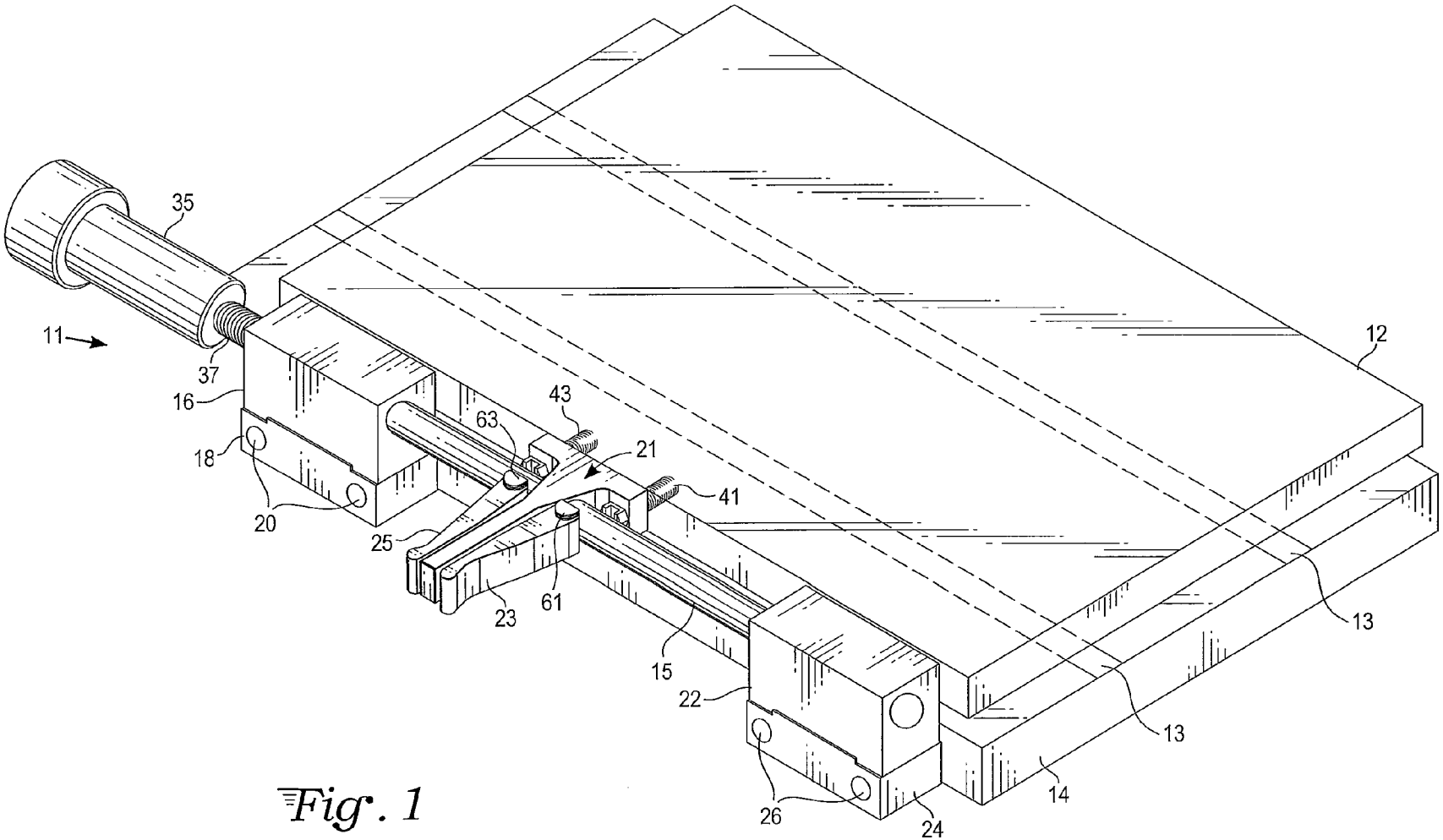
FIG. 1 is a front perspective view of a stage driver of the present invention connected to a fixed stage driving a horizontally movable stage.
Figure 12:
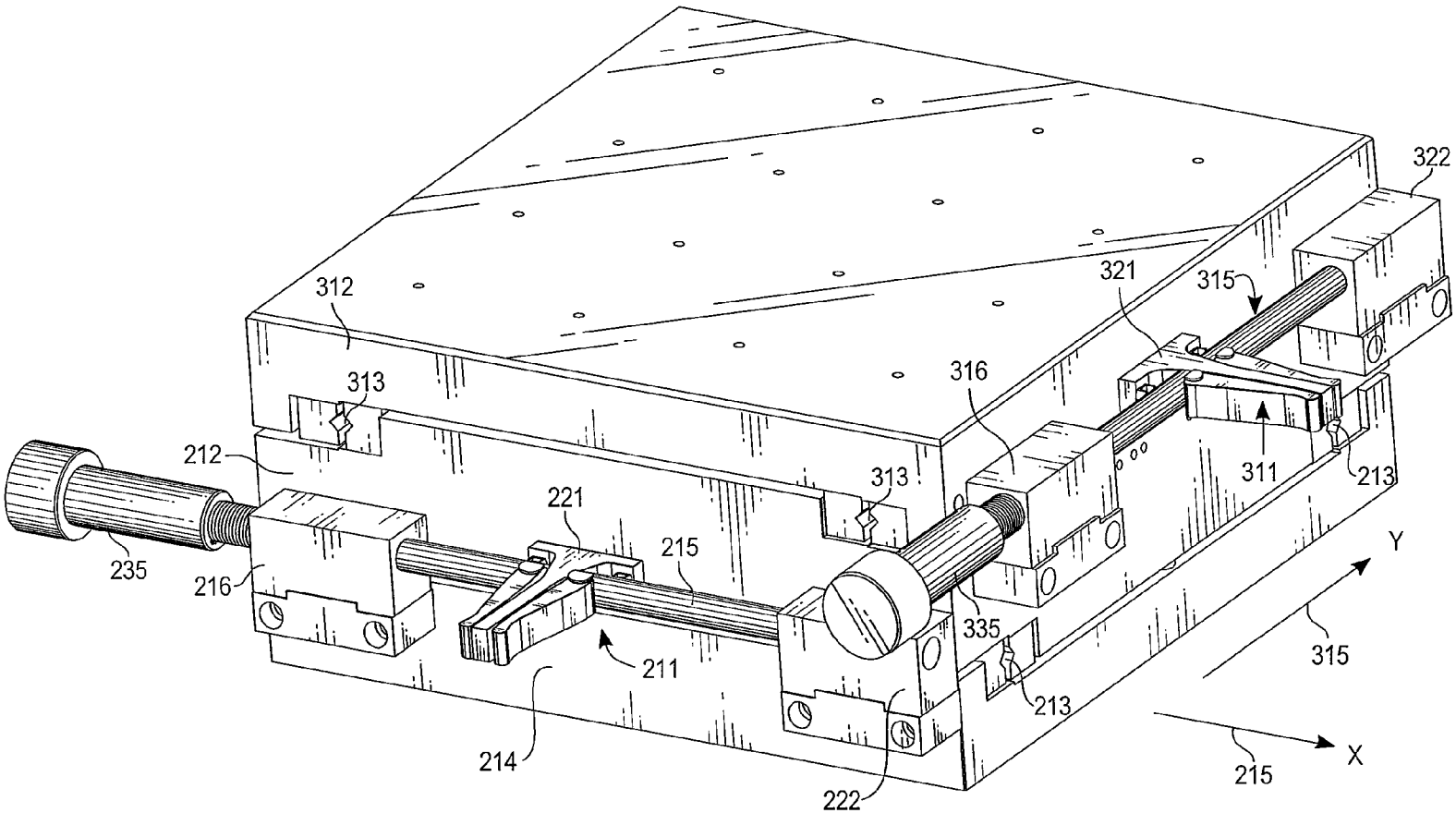
FIG. 12 is a front perspective view of two stage drivers of the present invention with a first stage movable in the x-direction connected to a fixed stage and a second stage movable in the y-direction connected to the first stage.

With reference to FIG. 1, a stage driver 11 is shown having a portion attached to movable stage 12 and another portion attached to fixed stage 14. Rails 13 are set on top of fixed stage 14 allowing free motion of movable stage 12 on the rails. Rails 13 need not be on top of the stage but could be arranged in other ways, one example being edgewise as shown in FIG. 12. Returning to FIG. 1, the stage 12 slides back and forth over the fixed stage 14 on the rails in x-direction motion. The stages are typically flat and made of stable, durable material such as solid metal plates.

Stage driver 11 has a shaft 15 that is aligned parallel to the direction of motion of the movable stage 12. The shaft 15 is supported by spaced-apart blocks that will be described later. One of the chief purposes of the shaft is to support yoke 21 which has a T-shape with a bore that allows sliding on shaft 15. Shaft 15 is shown as round, a preferred shape, but may be square or polygonal in cross-section so long as the yoke slides on the shaft. Screws 41 and 43 anchor the yoke 21 to the movable stage 12. Alongside the yoke body are a first pivot member 23 and a symmetrically disposed second pivot member 25. The pivot members are hand holdable members that pivot in opposite directions. The yoke may be controlled by fingers of a user who pinches the first and second pivot members together allowing free sliding of the yoke on the shaft. When fingers are released from the pivot members, the pivot members have inward ends which make contact with shaft 15 locking the yoke in place as will be explained below. The shaft is supported at opposite ends by support blocks including a first lower support block 18 which is fixed to the fixed stage 14 by means of fasteners 20. A first upper support block 16 has an axial bore allowing shaft 15 to be seated therein by means of a threaded connection using threads 37 controlled by knob 35.

In other words, the shaft screws into the first upper support block providing a very fine position control of the shaft with regard to the fixed stage. The first upper support block 16 is connected to the first lower support block 18 by means of fasteners not shown. The fasteners allow slight adjustment of the position of the upper support block with respect to the lower support block.

Opposite the support blocks 16 and 18 are the second upper support block 22 which is connected to second lower support block 24 at the distal end of shaft 15. The second lower support block 24 is connected to the fixed stage 14 by means of fasteners 26 in the same manner that the first lower support block 18 is connected to the fixed stage 14 by means of the fasteners 20. The second upper support block 22 has an axial bore allowing the shaft to be supported therein. No threads are present and shaft 15 merely slides into the second upper support block 22 and can move slightly by force of the previously mentioned screw.

Figure 2:
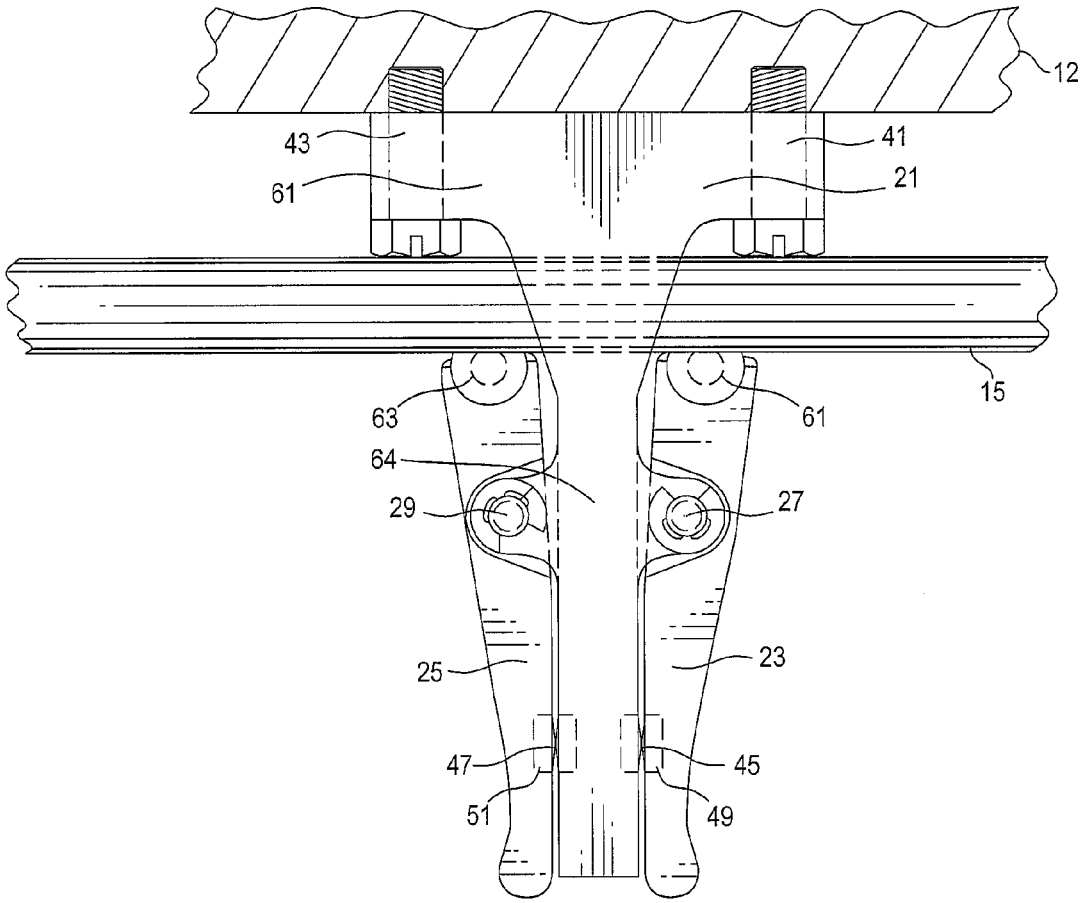
FIG. 2 is a bottom view of a yoke employed in the stage driver of FIG. 1.

With reference to FIG. 2, a first pivot 27 is seen connected to yoke 21. Similarly, a second pivot 29 is symmetrically located opposite first pivot 27 on the yoke body. The yoke consists of a T-top 61 and T-base 64 with the pivots approximately in the midpoint of T-base 64. The first pivot 27 connects the first pivot member 23 to the yoke. A first end of the pivot member has a truncated disk, i.e., a captured floating, i.e., rotatable, disk with a flat spot that acts as a flat finder 61 for flat contact with the shaft. A similar second flat finder 63 is associated with the second pivot member 25. Each flat finder is free to turn because the flat finder is loosely held at the end of each pivot member. The flat finder extends forwardly in the direction of shaft 15 further than an end of the associated pivot member. This means that only the flat finder will be in contact with a shaft and not the associated pivot member. The flat spot of each flat finder will come into flat contact with shaft 15 and act as a wedge opposing yoke motion on the shaft against the associated pivot member in one direction.

With two pivot members having flat finders engaged, motion of the yoke relative to shaft 15 will be locked in place by opposed wedging action that is stronger than a friction brake and has no lash that a rack and pinion brake might have. To unlock yoke 21 each pivot member is pushed toward the T-base 64 of the yoke. This can be done by simultaneous pinching together of the outward ends of the pivot members. A first spring 45 associated with hollow receiving detents 49 and a second spring 47 held by detents 51 in each of the respective pivot members 23 and 25 provide force opposing the pinching together of the pivot members. However, such pinching causes pivoting of the two pivot members releasing the flat finders from contact with the shaft, thereby providing clearance between the pivot members and the shaft in allowing motion of yoke 21 with respect to shaft 15. This allows coarse motion of the movable stage 12.

Figure 3:
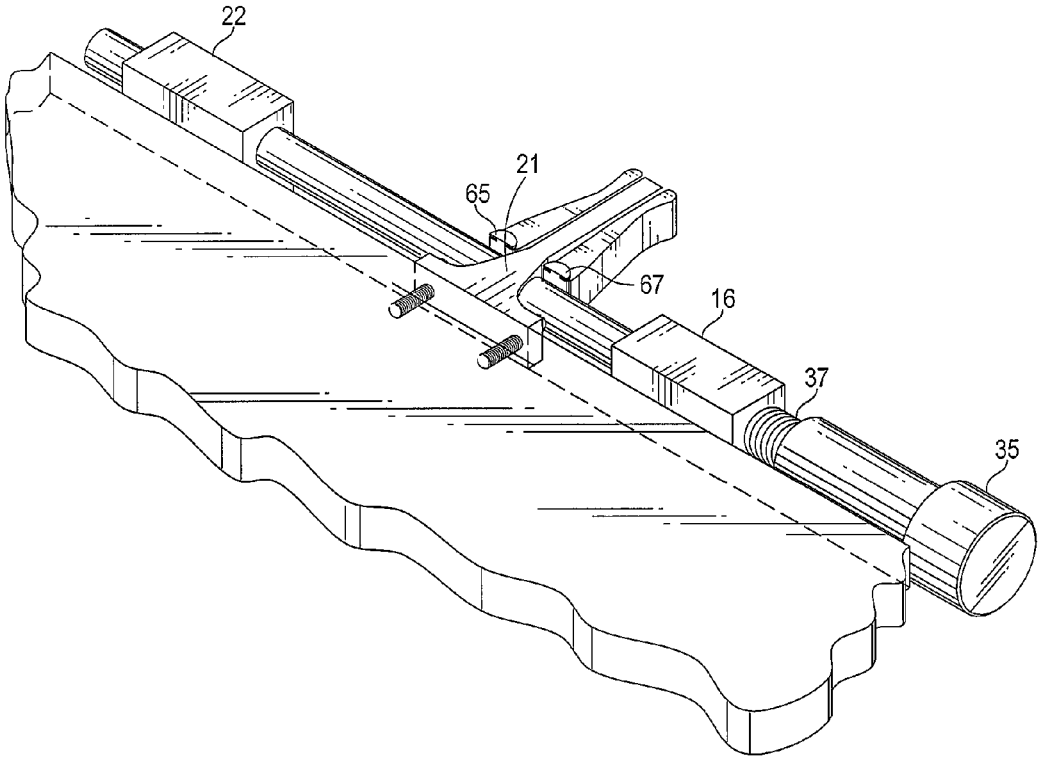
FIG. 3 is a back perspective view of the stage driver of FIG. 1.

In FIG. 3, fine motion of yoke 21, locked in place by the flat finders 65 and 67, is controlled by screw threads 37 which may be advanced into the first upper support block 16 by means of fine threads 37. The threads are turned by knob 35. In operation, once yoke 21 is locked in place, small movements of shaft 15 may be forced by turning knob 35. Such small movements will carry yoke 21 and hence the movable stage 12. Shaft 15 correspondingly slides slightly within a bore in the second upper support block 22 when knob 35 is turned.

Figure 4:
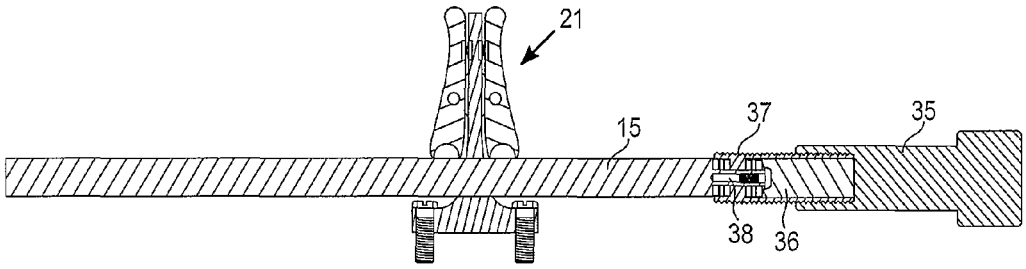
FIGS. 4 and 5 are respective locked and unlocked top sectional views of a yoke coarse position control device and a threaded end fine position control device in the stage driver of FIG. 1.
Figure 5:
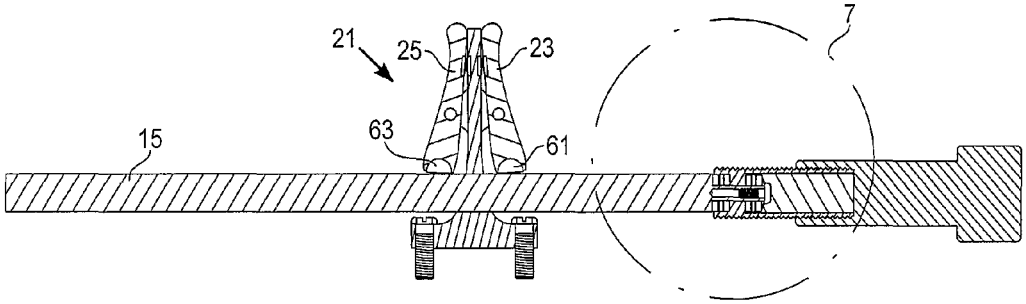
Figure 6:
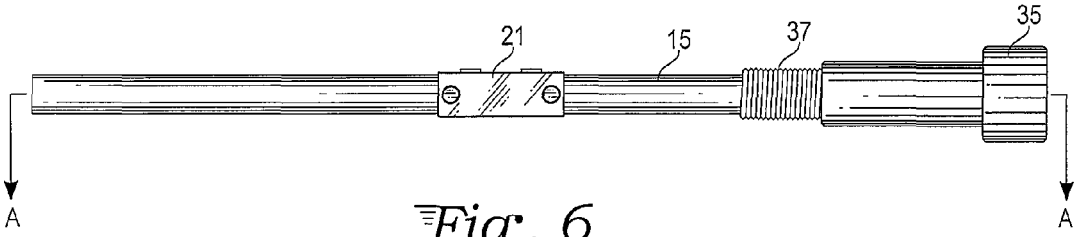
FIG. 6 is a back view of the stage driver of FIG. 3 without mounting blocks.
Figure 7:
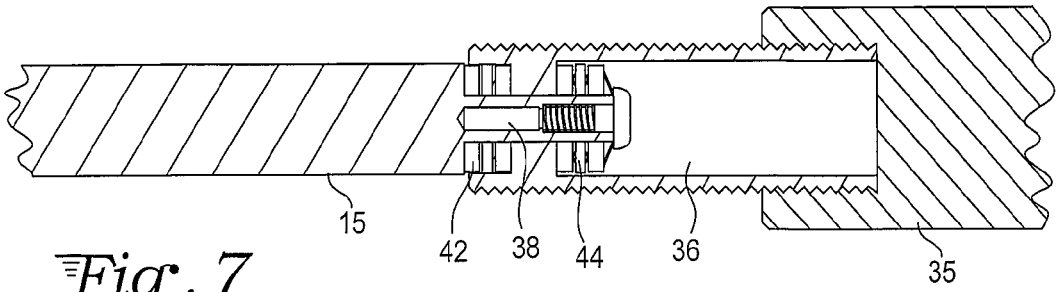
FIG. 7 is a side sectional view of a portion of the threaded end fine position control device shown in FIGS. 4 and 5.
Figure 11:
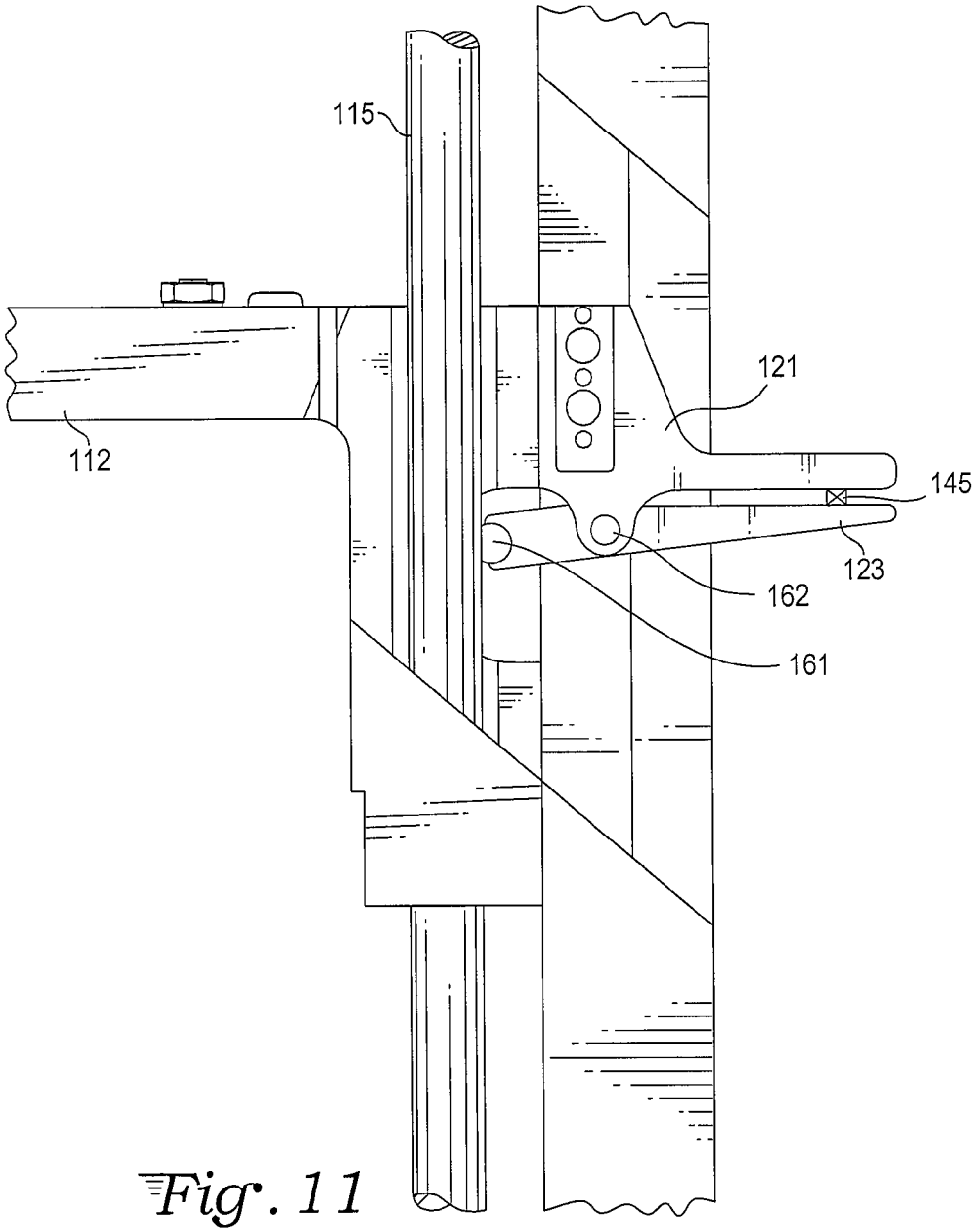
FIG. 11 is an enlarged detail view of a yoke employed in the stage driver apparatus of FIG. 8.
Figure 9:
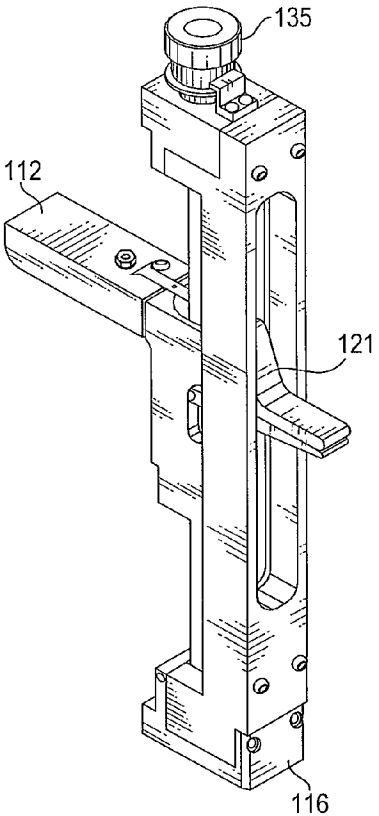
FIG. 9 is a perspective view of the apparatus of FIG. 8.
Figure 10:
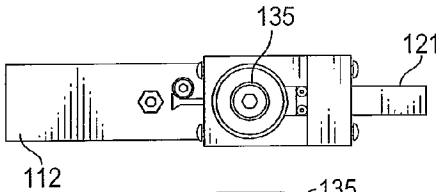
FIG. 10 is a top view of the apparatus of FIG. 8.
Figure 8:
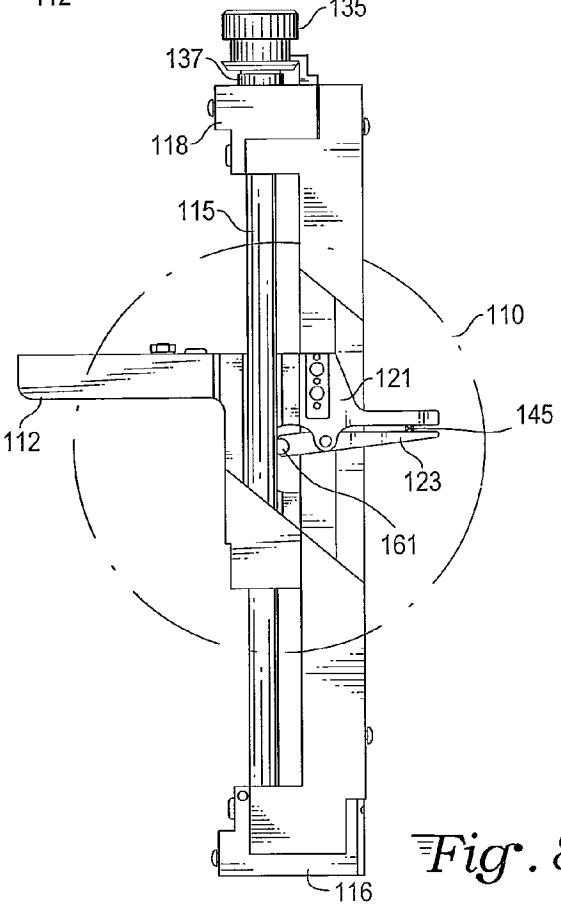
FIG. 8 is a side view of an alternate embodiment of a stage driver of the present invention connected to a vertically movable stage.

In FIG. 4, yoke 21 is seen to be locked in place. Knob 35 is seen to be joined to shaft 15 by means of a threaded barrel 36 joined to shaft 15 by means of a screw 38. In FIG. 5, the pivot members 23 and 25 are seen to be pinched together, at ends away from shaft 15 against the T-base of the yoke, thereby releasing the flat finders 61 and 63 from contact with shaft 15. This allows sufficient slight clearance for sliding of yoke 21 along shaft 15. The yoke will carry a movable stage member, not shown. FIG. 6 shows that the height of yoke 21 is slightly greater than the diameter of shaft 15. In FIG. 7, the barrel 35 is seen to be connected to shaft 15 by screw 38 that has thrust bearings 42 and 44 to maintain constant tension between shaft 15 and sleeve 36.

In the embodiment of FIGS. 8-11, the upright shaft 115 is vertically disposed on a fixed support stand 116. An upper fixed support block 118 allows a threaded sleeve 137 to slightly move the shaft vertically by means of knob 135. Yoke 121 has a bore therethrough allowing it to move vertically on the shaft 115 when the single pivot member 123 is clear of the shaft by being pinched towards the yoke body, upon pivoting about yoke pivot 162. A spring 145 provides bias of the pivot member 123 toward the shaft so that a flat finder member 161, similar to flat finder member 61 described above, contacts shaft 115 to lock yoke 121 in place, with gravity providing a wedging force against downward movement of yoke 121. When the flat finder 161 is pivoted away from shaft 115 yoke 121 is free to move to any position on shaft 115.

In operation, the pivot member 123 is pinched against yoke 121 such that the flat finder 161 is clear of shaft 115. A coarse position of the movable stage 112 may be established and then the first pivot member 123 is released so that the flat finder 161 contacts shaft 115. This locks the position of yoke 121 relative to shaft 115. A fine position for the stage 112 may now be established by turning knob 135 which slightly adjusts the vertical position of shaft 115 relative to the support block 118 as the threaded member 137 to which shaft 115 is affixed turns in and out of the support block 118. Note that in the embodiment of FIGS. 8-11, there is no fixed stage, per se, only a movable stage with fixed support blocks. Fine positioning is always optional and not required.

With reference to FIG. 12, a first stage driver 211 moves first movable stage 212 in the x-direction, indicated by arrow 215. Stage driver 211 has yoke 221 connected to first movable stage 212. Yoke 221 slides on shaft 215 supported in blocks 216 and 222 that are fixed to fixed stage 214. The first movable stage 212 slides over fixed stage 214 on parallel rails 213, the two stages being in close proximity, being parallel and separated by only a space on the order of a millimeter or two.

In a similar manner, a second stage driver 311 moves second movable stage 312 in the y-direction, indicated by arrow 315, over the first movable stage 212. Stage driver 311 has yoke 321 connected to second movable stage 312. Yoke 321 slides on shaft 315 supported in blocks 316 and 322 that are fixed to the movable stage 212. When stage 212 moves, then stage 312 also moves. However, stage 312 can also move when stage 212 is not moving. Stage 312 slides over stage 212 on parallel rails 313, the rails oriented in the y-direction. The rails provide the slight spacing between stages. Rails can be upright, side mounted as shown, or any configuration that allows linear motion. The two stages are in close proximity, being parallel and so slightly separated as the fixed stage 214 and the first stage 212. Besides the coarse movement caused by the yokes, fine motion is possible by turning screw threads associated with each shaft that are turnable into a supporting block. Knobs 235 and 335 produce the fine motion control after a coarse position is established.

What is claimed is:

1. A stage driver for a movable stage comprising:

a shaft adjacent to an outer edge of a movable stage;

a yoke slideable on said shaft, the yoke having a portion affixed to the outer edge of the movable stage, the yoke having at least one holdable pivot member, joined to the yoke at a pivot, with a first end that can contact the shaft in a first pivoted position that locks the yoke relative to the shaft and that pivots away from the shaft in a second pivot position that frees the yoke for sliding on the shaft, the pivot member having a second end that controls pivoting in relation to the yoke, the second end moving toward the yoke when the first end moves away from the yoke, whereby freeing the yoke from the shaft by pivoting the pivot member away from the shaft allows the yoke to slide along the shaft, thereby moving the movable stage concurrently wherein the shaft is supported in apertures in fixed blocks with screw threads on one block and on the shaft turned by a knob at an end of the shaft, whereby turning of the knob changes the linear position of the shaft relative to the blocks.

2. The stage driver of claim 1 wherein the fixed blocks are connected to a fixed stage having portions parallel to and proximately below the movable stage whereby the movable stage slides over the fixed stage.

3. A driver for a stage having a fixed member and a member movable relative to the fixed member in a linear direction comprising:

a guide shaft oriented in a direction parallel to a linear direction of motion of a movable stage member and having opposed ends supported by spaced apart blocks, one of the shaft ends having a fine motion adjustment device relative to the blocks;

a yoke slideably mounted on the shaft and affixed to the movable stage member thereby controlling coarse motion of the movable stage member;

the yoke having at least one holdable pivot member, joined to the yoke at a pivot, with a first end that can contact the shaft in a first pivoted position that locks the yoke relative to the shaft and that pivots away from the shaft in a second pivot position that frees the yoke for sliding on the shaft, the pivot member having a second end that holdably controls pivoting in relation to the yoke, the second end moving toward the yoke when the first end moves away from the yoke, whereby freeing the yoke from the shaft by pivoting the pivot member away from the shaft allows the yoke to slide along the shaft to establish a rough position of the movable stage and the fine motion adjustment device allows establishing a fine position of the movable stage.

4. The apparatus of claim 3 wherein two pivot members are disposed on opposite sides of the yoke, each pivot member having a first end that contacts the shaft in a first position that locks the position of the yoke relative to the shaft and that pivots away from the shaft in a second position that frees the position of the yoke, the two pivot members moving in mutually opposite directions.

5. The apparatus of claim 4 wherein the two pivot members are spring biased relative to the yoke in a manner such that relaxed spring positions bias the pivot members into contact with the shaft thereby self-locking the yoke against the shaft and pinching the pivot members together toward the yoke allows the yoke to slide along the shaft to establish a rough position of the movable stage.

6. The apparatus of claim 3 wherein the fine motion adjustment device comprises screw threads on the shaft turned by a knob at an end of the shaft, the threads coupled to one of the blocks whereby turning of the knob changes the position of the shaft relative to the blocks.

7. The apparatus of claim 3 wherein the blocks are affixed to a fixed stage having portions parallel to and proximately below the movable stage whereby the movable stage slides over the fixed stage.

8. The stage driver apparatus of claim 3 wherein a pair of guide shafts as set forth in claim 3 are oriented in X-Y orthogonal orientation thereby providing X-Y motion to two parallel, spaced apart, movable stages associated with the guide shafts.

9. The stage driver of claim 8 wherein the two movable stages are spaced apart by rails oriented in x and y directions.

10. The stage driver of claim 3 wherein the pivot member has a rotatable disk with a flat spot facing the shaft at the first end of the finger wherein the flat spot extends further towards the shaft than other portions of the first end thereby allowing the flat spot to bring the pivot member into contact with the shaft.

11. The stage driver of claim 3 wherein the yoke comprises a symmetrical T-shaped body with a T-top affixed to the movable member and a T-base extending away from the T-top and providing a pivot location for the pivot member.

12. The stage driver of claim 11 wherein said T-top is affixed to the movable member by a pair of spaced apart screws extending from the yoke into said movable member.

* * * * *